US005781954A

United States Patent [19]

Mayer

[11] Patent Number: 5,781,954

[45] Date of Patent: Jul. 21, 1998

[54] EXTENSION RAMP FOR USE IN COMBINATION WITH A CAR RAMP

[75] Inventor: Claude Mayer, St.-Théodore-d'Acton, Canada

[73] Assignee: Camoguid Inc., Quebec, Canada

[21] Appl. No.: 731,604

[22] Filed: Oct. 16, 1996

Related U.S. Application Data

[60] Provisional application No. 60/005,644, Oct. 19, 1995.

[51] Int. Cl.[6] ..... E01D 1/00; E02C 3/00

[52] U.S. Cl. ..... 14/69.5; 254/88

[58] Field of Search ..... 14/69.5, 71.1; D34/32; 254/88; 414/537

[56] References Cited

U.S. PATENT DOCUMENTS

| | | | |
|---|---|---|---|
| D. 300,073 | 2/1989 | Crump | D34/32 |
| D. 313,102 | 12/1990 | Cano | D34/32 |
| D. 348,552 | 7/1994 | Woodward et al. | D34/32 |
| D. 351,710 | 10/1994 | Richardson | D34/32 |
| D. 353,930 | 12/1994 | Johnson | D34/32 |
| 3,580,373 | 5/1971 | Stickle | 193/5 |
| 3,984,891 | 10/1976 | Weinmann | 14/69.5 |
| 4,013,268 | 3/1977 | Williams | 254/88 |
| 4,478,549 | 10/1984 | Stelly et al. | 414/537 |
| 4,601,632 | 7/1986 | Agee | 414/537 |
| 4,845,792 | 7/1989 | Bakula et al. | 14/69.5 |
| 4,920,596 | 5/1990 | Stevens | 14/69.5 |
| 5,033,146 | 7/1991 | Fogarty et al. | 14/69.5 |
| 5,341,533 | 8/1994 | Seitz | 14/69.5 |
| 5,446,937 | 9/1995 | Haskins | 14/69.5 |
| 5,645,394 | 7/1997 | Hays | 414/537 |

*Primary Examiner*—James Lisehora

*Attorney, Agent, or Firm*—Ware, Fressola, Van Der Sluys & Adolphson LLP

[57] ABSTRACT

The extension ramp is suitable for use with a car ramp having a raised platform portion for supporting a car wheel and a downwardly elongated sloped portion connected thereto, the sloped portion having a given inclination with respect to the platform portion. The extension ramp comprises a substantially elongated straight portion having a free end mountable along the sloped portion of the car ramp and a slanted portion connected to a second end of the straight portion and forming an obtuse angle with the straight portion. The slanted and straight portions are defining together a passage for a car wheel and the slanted portion has a free end for laying on the ground and for receiving the car wheel. The free end of the straight portion is securable along the sloped portion of the car ramp, whereby the extension ramp is mountable on the car ramp for lowering the inclination of the sloped portion of the car ramp. Advantageously, a combination of a conventional car ramp with an extension ramp according to the present invention is suitable for lifting any types of vehicles or car models, even those with low clearance. It also has a practical size, it is very easy to assemble and it is safe to use. Moreover, this combination has a very high load capacity, especially if the car ramp and the extension ramp are made of high strength metal.

19 Claims, 2 Drawing Sheets

EXTENSION RAMP FOR USE IN COMBINATION WITH A CAR RAMP

This application claims benefit to U.S. Provisional Application No. 60/005,644, filed on Oct. 19, 1995.

FIELD OF THE INVENTION

The present invention relates to heavy duty ramps used for raising a vehicle and thereby allowing access to the underside thereof.

BACKGROUND OF THE INVENTION

Car ramps allowing access to undercarriages are already known in prior art and are largely used when repairs are required underneath a vehicle. These ramps allow a user to raise either the front end or the back end of the vehicle. The ramps known in prior art are likely made of steel and comprise an elongated sloped portion connected to a platform portion where a car wheel may be lifted off.

Although these prior art ramps are suitable for certain types of vehicles, it has been found that they are not satisfactory for many other types of vehicles, especially for vehicles having very low profiles front ends. For example, new car designs with bodies extending closer to the ground or with special ornaments such as front or rear spoilers can hardly be lifted on the prior art ramps. This is mainly due to the low clearance of these vehicles, causing the underneath body of the car or these spoilers to be blocked by the sloped portion of the ramp which has a slope too steep. Very often, someone using this type of ramp with a low profile car had to maneuver with a beam in order to lift the car on top of the ramp, therefore creating a severe risk of car damages or even body injury.

For the foregoing reasons, there is presently a need for a ramp suitable for raising a wide variety of vehicles that is easy to handle, safe for the user and low in cost.

SUMMARY OF THE INVENTION

An object of the present invention is to provide a car ramp that satisfies these above needs.

More particularly, an object of the present invention is to propose an extension ramp for use with a car ramp having a raised platform portion for supporting a car wheel and a downwardly elongated sloped portion connected thereto, the sloped portion having a given inclination with respect to the platform portion, the extension ramp comprising:

a substantially elongated straight portion having a free end mountable along the sloped portion of the car ramp;

a slanted portion connected to a second end of the straight portion and forming an obtuse angle with the straight portion, the slanted and straight portions defining together a passage for a car wheel, the slanted portion having a free end for laying on the ground and for receiving the car wheel; and securing means for securing the extension ramp to the car ramp, the securing means being also for aligning the extension ramp with the car ramp and for holding in place the extension ramp on the car ramp, whereby the extension ramp is mountable on the car ramp for lowering the inclination of the sloped portion of the car ramp.

Another object of the present invention is to propose a car ramp assembly consisting of the combination of an extension ramp as described above with a prior art car ramp having a raised platform flat portion for supporting a car wheel, and a downwardly elongated sloped portion connected to the raised platform flat portion and having a given inclination with respect to the platform portion.

As can be appreciated, an extension ramp according to the present invention provides a very solid car ramp suitable for lifting a wide variety of vehicles, particularly vehicles with very low clearance.

The foregoing and other objects, features and advantages of the invention will be more apparent from the following more particular description of a preferred embodiment of the invention, as illustrated in the accompanying drawings.

A non restrictive description of a preferred embodiment will now be given with reference to the appended drawings.

DESCRIPTION OF A PREFERRED EMBODIMENT

Figure 1:
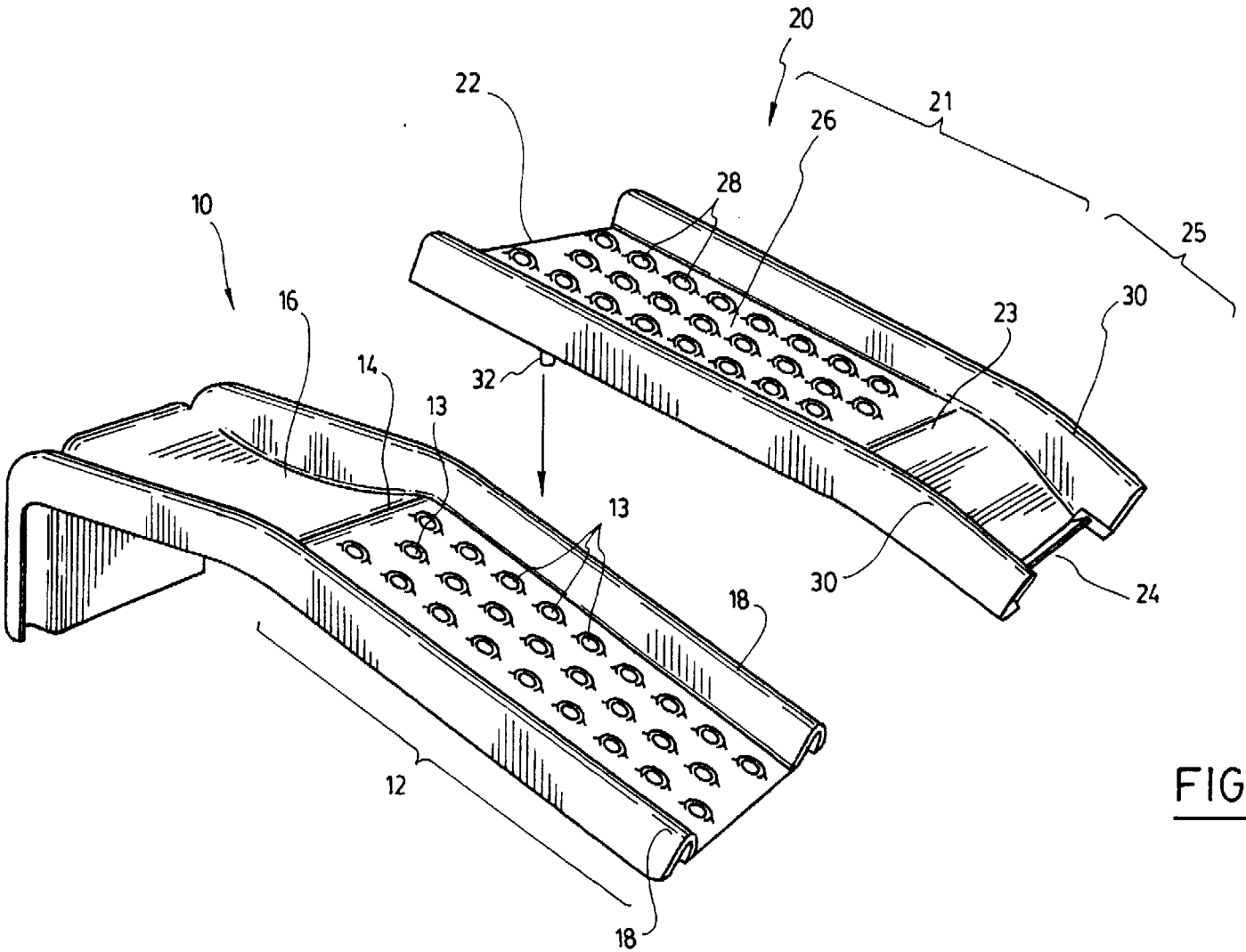
FIG. 1 is an exploded perspective view of an extension ramp according to the present invention in combination with a prior art ramp.
Figure 2:
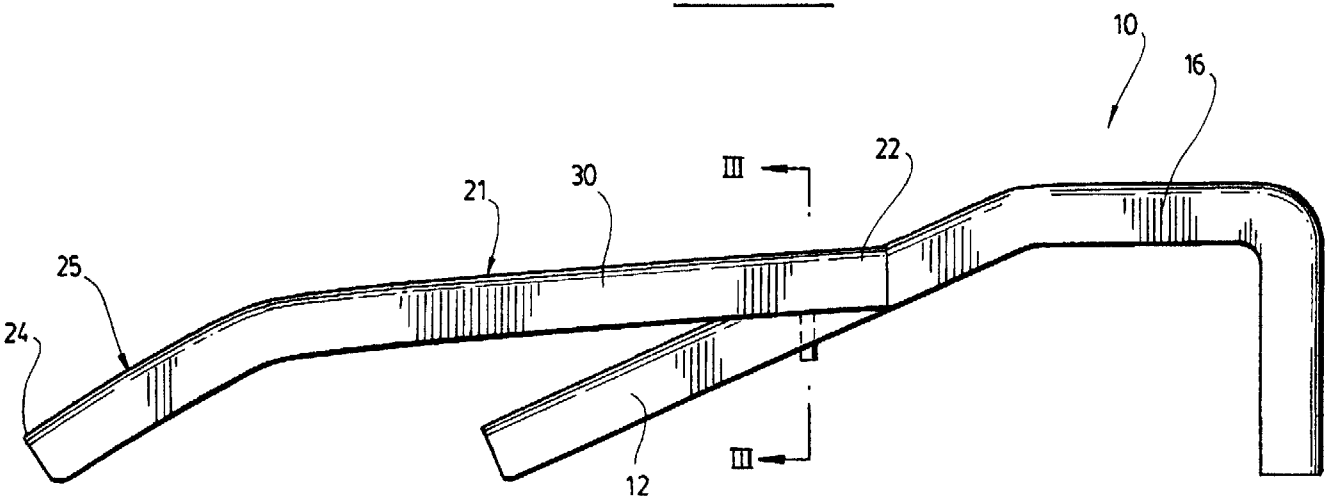
FIG. 2 is a side elevational view of the extension ramp of FIG. 1 mounted on the car ramp of FIG. 1.

Referring to FIGS. 1 and 2, a combination of a traditional car ramp (10) with an extension ramp (20) is illustrated. The car ramp (10) is preferably made of a high strength metal and it has a raised platform portion (16) for supporting a car wheel and a downwardly sloped portion (12) connected to an end (14) thereof. The sloped portion (12) has a given inclination with respect to the platform portion (16). As can be appreciated, the platform portion (16) is raised above the ground level so that, when the front wheels or the rear wheels of a vehicle (not illustrated) are mounted on two of these ramps (10), a person has an easy access to the undercarriage of the vehicle for repairing it for example. Preferably, the car ramp (10) is provided along its sloped portion (12) and platform portion (16) with opposed side edges (18) projecting upwardly therefrom for preventing a car wheel from falling off and it has a width wide enough to allow a car wheel to lay on.

The extension ramp (20) is preferably made of a high strength metal or metal alloy and it comprises a substantially elongated straight portion (21) having a free end (22) mountable along the sloped portion (12) of the car ramp (10). The extension ramp (20) further comprises a slanted portion (25) connected to a second end (23) of the straight portion (21) and forming an obtuse angle therewith. The slanted portion (25) has a free end (24) for laying on the ground and for receiving a car wheel. The slanted portion (25) together with the straight portion (21) define a passage for the car wheel.

Figure 3:
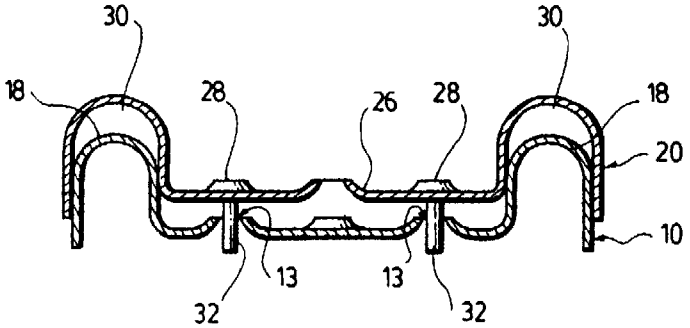
FIG. 3 is a cross-sectional view along line III—III of FIG. 2, showing the manner in which the extension ramp is mounted on the car ramp.

Referring more particularly to FIGS. 2 and 3, the extension ramp (20) further comprises securing means for securing the extension ramp to the car ramp. The securing means is preferably securing the free end (22) of the straight portion (21) along the sloped portion (12) of the car ramp (10), whereby the extension ramp (20) is mountable on the car ramp (10) for lowering the inclination of the sloped portion (16) of the car ramp (20). Preferably, as illustrated, the securing means comprises at least one projecting element (32) projecting from a bottom surface (27) of the extension ramp (20) near the free end (22) thereof. The extension ramp (20) illustrated is provided with two of these projecting element (32) which simply consist of pegs projecting downwardly from the bottom surface (27) of the extension ramp (20). Each of the pegs (32) is devised to engage a corresponding aperture provided in the sloped portion (12) of the car ramp (10).

Preferably, the free end (22) of the straight portion (21) has opposite side edges (30) each having a setting portion for mating a portion of a corresponding side edge (18) of the car ramp (10) whereby, for mounting the free end (22) on the sloped portion (12) of the car ramp (10), the setting portion of each side edge (30) is set over the corresponding side edge (18) of the car ramp (10). As best illustrated in FIG. 3, the side edges (18) of the car ramp (10) have an inverted U-shaped section and they are projecting upwardly for preventing any wheel mounted thereon from falling off. Thereby, the side edges (30) of the free end (22) of the extension ramp (20) also have a U-shaped section conforming or mating the side edges (18) of the car ramp (10). Preferably, the entire extension ramp (20), including the slanted and straight portions (25.21) is provided with side edges (30) having a U-shaped section, thereby making the extension ramp (20) more resistant.

Preferably, the straight portion (21) of the extension ramp (20) has an upper surface (26) provided with grip means for providing grip to the car wheel and preventing any slipping thereof. The grip means may comprise a plurality of protrusions or ground grippers (28) projecting from the upper surface (26) of the straight portion (21). In the illustrated preferred embodiment, each protrusion consists of an upwardly perforated hole (28) through the extension ramp.

Also preferably, the free end (24) of the slanted portion (25) is upwardly angulated with respect to the slanted portion (25), thereby providing grip to the car wheel.

In use, when a vehicle has to be raised, the upper end (22) of the extension ramp (20) simply has to be mounted and secured along the slopped portion (12) of the car ramp (10), thereby lowering the inclination of the entire car ramp assembly and allowing to lift vehicles with very low profile.

As can be appreciated, this combination of a conventional car ramp (10) with an extension ramp (20) according to the present invention is suitable for lifting any types of vehicles or car models, even those with low clearance. It also has a practical size, it is very easy to assemble and it is safe to use. Moreover, this combination has a very good load capacity, especially if the car ramp and the extension ramp are made of high strength metal.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

I claim:

1. An extension ramp for use with a car ramp having a raised platform portion for supporting a car wheel and a downwardly elongated sloped portion connected thereto, the downwardly elongated sloped portion having a given inclination with respect to the raised platform portion, the extension ramp comprising:

a substantially elongated straight portion having a free end mountable along the downwardly elongated sloped portion of the car ramp;

a slanted portion connected to a second end of the substantially elongated straight portion and forming an obtuse angle with the substantially elongated straight portion, the slanted portion and the substantially elongated straight portion defining together a passage for a car wheel, the slanted portion having a free end for laying on the ground and for receiving the car wheel; and securing means for securing the extension ramp to the car ramp, the securing means being also for aligning the extension ramp with the car ramp and for holding the extension ramp in place on the car ramp, whereby the extension ramp is mountable on the car ramp for lowering the inclination of the downwardly elongated sloped portion of the car ramp.

2. An extension ramp as claimed in claim 1, wherein the free end of the substantially elongated straight portion has opposite side edges each having a setting portion for mating a portion of a corresponding side edge of the car ramp whereby, for mounting the free end on the downwardly elongated sloped portion of the car ramp, the setting portion of each side edge is set over the corresponding side edge of the car ramp.

3. An extension ramp as claimed in claim 2, wherein the setting portion of each side edge has a U-shaped section.

4. An extension ramp as claimed in claim 3, wherein the substantially elongated straight portion and the slanted portion are each provided with opposite side edges having a U-shaped section.

5. An extension ramp as claimed in claim 4, wherein the securing means comprises at least one projecting element projecting from a bottom surface of the extension ramp near the free end thereof, the at least one projecting element to engage a corresponding aperture provided in the sloped portion of the car ramp.

6. An extension ramp as claimed in claim 5, wherein the substantially elongated straight portion has an upper surface with grip means for providing grip to the car wheel.

7. An extension ramp as claimed in claim 6, wherein the grip means comprises a plurality of protrusions projecting from the upper surface of the extension ramp.

8. An extension ramp as claimed in claim 7, wherein the extension ramp is made of a high strength metal or metal alloy.

9. An extension ramp as claimed in claim 8, wherein each protrusion consists of an upwardly perforated hole through the substantially elongated straight portion.

10. An extension ramp as claimed in claim 9, wherein the free end of the slanted portion is angled upwardly with respect to the slanted portion, thereby providing grip to the car wheel.

11. A car ramp assembly comprising:

(a) a first car ramp having:

a raised platform flat portion for supporting a car wheel, and a downwardly elongated sloped portion connected to the raised platform flat portion and having a given inclination with respect to the raised platform flat portion; and (b) an extension ramp comprising:

a substantially elongated straight portion having a free end mountable along the downwardly elongated sloped portion of the car ramp, a slanted portion connected to a second end of the substantially elongated straight portion and forming an obtuse angle with the substantially elongated straight portion, the slanted portion and substantially elongated straight portion defining together a passage for a car wheel, the slanted portion having a free end for laying on the ground and for receiving the car wheel, and securing means for securing the extension ramp to the car ramp, the securing means being also for aligning the extension ramp with the car ramp and for holding the extension ramp in place on the car ramp, whereby the extension ramp is mountable on the car ramp for lowering the inclination of the sloped portion of the car ramp.

12. A car ramp assembly as claimed in claim 11, wherein the free end of the substantially elongated straight portion has opposite side edges each having a setting portion for mating a portion of a corresponding side edge of the car ramp whereby, for mounting the free end on the downwardly elongated sloped portion of the car ramp, the setting portion of each side edge is set over the corresponding side edge of the car ramp.

13. An extension ramp as claimed in claim 12, wherein the setting portion of each side edge and each side edge of the car ramp have a U-shaped section.

14. A car ramp assembly as claimed in claim 13, wherein the substantially elongated straight portion and the slanted portion each have opposite side edges with a U-shaped section.

15. A car ramp assembly as claimed in claim 14, wherein:

the sloped portion of the car ramp has at least one hole; and the securing means comprises at least one projecting element projecting from a bottom surface of the extension ramp near the free end thereof, and each projecting element to engage a corresponding aperture of the car ramp.

16. A car ramp assembly as claimed in claim 15, wherein the passage for a car wheel has grip means for providing grip to the car wheel.

17. A car ramp assembly as claimed in claim 16, wherein the grip means comprises a plurality of protrusions projecting from an upper surface of the extension ramp.

18. A car ramp assembly as claimed in claim 17, wherein the car ramp and the extension ramp are each made of a high strength metal or metal alloy.

19. An extension car ramp as claimed in claim 18, wherein each protrusion consists of an upwardly perforated hole through the extension ramp.

* * * * *

UNITED STATES PATENT AND TRADEMARK OFFICE

CERTIFICATE OF CORRECTION

PATENT NO. : 5,781,954

DATED : July 21, 1998

INVENTOR(S) : Mayer

It is certified that error appears in the above-indentified patent and that said Letters Patent is hereby corrected as shown below:

Column 2, line 63, delete "(16)" and insert --(10)--

Column 3, line 4, "after aperture" insert --(13)--

Column 3, line 37, please delete "slopped" and insert --sloped--

Signed and Sealed this

Fifth Day of January, 1999

*Attest:*

*Attesting Officer*

*Acting Commissioner of Patents and Trademarks*